US010219090B2

(12) United States Patent
Adams et al.

(10) Patent No.: US 10,219,090 B2
(45) Date of Patent: Feb. 26, 2019

(54) METHOD AND DETECTOR OF LOUDSPEAKER DIAPHRAGM EXCURSION

(71) Applicant: Analog Devices Global, Hamilton (BM)

(72) Inventors: Robert Adams, Acton, MA (US); Kim Spetzler Berthelsen, Køge (DK)

(73) Assignee: Analog Devices Global, Hamilton (BM)

( * ) Notice: Subject to any disclaimer, the term of this patent is extended or adjusted under 35 U.S.C. 154(b) by 334 days.

(21) Appl. No.: 13/779,314

(22) Filed: Feb. 27, 2013

(65) Prior Publication Data

US 2014/0241536 A1 Aug. 28, 2014

(51) Int. Cl.
*H04R 29/00* (2006.01)
*H04R 3/00* (2006.01)

(52) U.S. Cl.
CPC ..... *H04R 29/003* (2013.01); *H04R 3/007* (2013.01)

(58) Field of Classification Search
CPC ..... H04R 3/007; H04R 29/001; H04R 1/02; H04R 2499/11; H04R 1/025; H04R 1/028; H04R 1/2803; H04R 2201/003; H04R 3/04; H04R 3/08; H04R 19/005; H04R 19/02; H04R 1/00; H04R 1/06; H04R 1/22; H04R 1/225; H04R 1/2834; H04R 1/2888
See application file for complete search history.

(56) References Cited

U.S. PATENT DOCUMENTS 3,875,341 A * 4/1975 Gassmann ..... H04B 1/667 704/205
4,514,109 A * 4/1985 McKenna ..... F16C 35/073 192/74
4,541,109 A * 9/1985 Shimizu ..... H04H 20/49 381/15
5,031,221 A 7/1991 Yokoyama
5,548,650 A 8/1996 Clark
5,613,218 A * 3/1997 Li ..... H03G 3/005 455/296

(Continued)

FOREIGN PATENT DOCUMENTS

CN 102802104 A 11/2012
DE 19804992 C1 8/1999

(Continued)

OTHER PUBLICATIONS

Dodd, Mark, et al: Voice Coil Impedance as a Function of Frequency and Displacement.

(Continued)

*Primary Examiner* — Duc Nguyen
*Assistant Examiner* — Assad Mohammed
(74) *Attorney, Agent, or Firm* — Schwegman Lundberg & Woessner, P.A.

(57) ABSTRACT

The present invention relates in one aspect to a method of detecting diaphragm excursion of an electrodynamic loudspeaker. The method comprises steps of generating an audio signal for application to a voice coil of the electrodynamic loudspeaker and adding a high-frequency probe signal to the audio signal to generate a composite drive signal. The method further comprises a step of applying the composite drive signal to the voice coil through an output amplifier and detecting a modulation level of a probe signal current flowing through the voice coil.

29 Claims, 6 Drawing Sheets

(56) References Cited

U.S. PATENT DOCUMENTS

| | | | | |
|---|---|---|---|---|
| 5,931,221 | A | 8/1999 | Inoue et al. | |
| 6,122,380 | A * | 9/2000 | Pedlow, Jr. | H04N 5/607 348/483 |
| 7,034,731 | B2 | 4/2006 | Uramoto et al. | |
| 7,107,159 | B2 * | 9/2006 | German | G01N 3/30 702/33 |
| 7,298,296 | B1 * | 11/2007 | Kamath | H03H 17/0642 341/123 |
| 7,372,966 | B2 | 5/2008 | Bright | |
| 7,716,808 | B2 | 5/2010 | Hutt et al. | |
| 8,538,039 | B2 | 9/2013 | Pfaffinger | |
| 8,712,065 | B2 | 4/2014 | Solgaard et al. | |
| 2001/0003541 | A1 * | 6/2001 | Koyano | H04R 3/002 381/111 |
| 2003/0021427 | A1 | 1/2003 | Nakada et al. | |
| 2004/0178852 | A1 | 9/2004 | Neunaber | |
| 2006/0126857 | A1 * | 6/2006 | Pavlov | H04R 29/003 381/59 |
| 2006/0172716 | A1 * | 8/2006 | Yoshii | H04L 27/2647 455/226.1 |
| 2007/0041606 | A1 * | 2/2007 | Sheppard, Jr. | 381/401 |
| 2009/0058549 | A1 * | 3/2009 | Kost | H03F 1/305 332/109 |
| 2009/0098714 | A1 * | 4/2009 | Chang | H01L 21/02381 438/478 |
| 2009/0220110 | A1 * | 9/2009 | Bazarjani | H03F 1/0211 381/120 |
| 2009/0268918 | A1 | 10/2009 | Solgaard et al. | |
| 2011/0258489 | A1 * | 10/2011 | Nielsen | H04B 17/0085 714/28 |
| 2012/0195443 | A1 * | 8/2012 | Kim | H03G 3/3005 381/107 |
| 2012/0249125 | A1 * | 10/2012 | Yamkovoy | H04R 29/003 324/207.13 |
| 2012/0281844 | A1 * | 11/2012 | Luo | H03F 1/52 381/55 |
| 2012/0308046 | A1 * | 12/2012 | Muza | H04R 19/02 381/111 |
| 2013/0077795 | A1 * | 3/2013 | Risbo | H04R 29/003 381/55 |
| 2013/0170660 | A1 * | 7/2013 | Kristensen | H04R 25/305 381/60 |
| 2013/0259245 | A1 | 10/2013 | Cheng et al. | |
| 2014/0254805 | A1 | 9/2014 | Su et al. | |

FOREIGN PATENT DOCUMENTS

| | | |
|---|---|---|
| EP | 2453670 | 5/2012 |
| EP | 2498511 A1 | 9/2012 |
| EP | 2538699 A1 | 12/2012 |
| WO | 97/03536 | 1/1997 |

OTHER PUBLICATIONS

Klippel, Wolfgang, et al: Loudspeaker Noninearities—Causes, Parameters, Symptoms. Dresden, Germany.

Thorborg, Knud, et al: An improved Electrical Equivalent Circuit Model for Dynamic Moving Coil Transducers. Audio Engineering Society, Convention Paper, presented at the 122nd Convention May 5-8, 2007, Vienna, Austria.

Extended European Search Report dated Jul. 22, 2014, in counterpart European application No. 14156524.2.

Clark, "Amplitude Modulation Method for Measuring Linear Excursion of Loudspeakers", Audio Engineering Society Convention Papers, AES Convention 89, Sep. 1, 1990, 18 pages.

Klippel, "Assesment of Voice-Coil Peak Displacement Xmax", Journal of the Audio Engineering Society, vol. 51, No. 5, May 2003, pp. 307-323.

Klippel, "Tutorial: Loudspeaker Nonlinearities—Causes, Parameters, Symptoms", Journal of the Audio Engineering Society, vol. 54, No. 10, Oct. 2006, pp. 907-939.

Clark et al., "Modeling and Controlling Excursion-Related Distortion in Loudspeakers", Audio Engineering Society Convention Papers, AES Convention 106, May 1999, 14 pages.

Klippel, "Active Reduction of Nonlinear Loudspeaker Distortion", Active 99 Conference, Dec. 1999, 12 pages.

Luo et al., "A Model Based Excursion Protection Algorithm for Loudspeakers", IEEE International Conference on Acoustics, Speech and Signal Processing (ICASSP), Mar. 2012, pp. 233-236.

"European Application Serial No. 14156524.2, Office Action dated Mar. 24, 2016", 6 pgs.

"European Application Serial No. 14156524.2, Office Action dated Jun. 30, 2015", 6 pgs.

"European Application Serial No, 14156524,2, Response filed Mar. 2, 2015 to European Search Report dated Jul. 22, 2014", 13 pgs.

"European Application Serial No. 14156524.2, Response filed Dec. 19, 2015 to Office Action dated Jun. 3, 2015", 25 pgs.

"Chinese Application Serial No. 201410065381.1, Office Action dated Nov. 14, 2016", (w/ English Translation), 18 pgs.

"European Application Serial No. 14156524.2, Response filed Mar. 2, 2015 to Extended European Search Report dated Jul. 22, 2014", 18 pgs.

"European Application Serial No. 14156524.2, Response filed Jul. 4, 2016 to Office Action dated Mar. 24, 2016", 8 pgs.

* cited by examiner

A)

B)

METHOD AND DETECTOR OF LOUDSPEAKER DIAPHRAGM EXCURSION

The present invention relates in one aspect to a method of detecting diaphragm excursion of an electrodynamic loudspeaker. The method comprises steps of generating an audio signal for application to a voice coil of the electrodynamic loudspeaker and adding a high-frequency probe signal to the audio signal to generate a composite drive signal. The method further comprises a step of applying the composite drive signal to the voice coil through an output amplifier and detecting a modulation level of a probe signal current flowing through the voice coil.

BACKGROUND OF THE INVENTION

The present invention relates to a method of detecting diaphragm excursion or displacement of electrodynamic loudspeakers and a corresponding loudspeaker excursion detector. Methodologies and devices for detecting diaphragm excursion of electrodynamic loudspeakers are highly useful for numerous purposes for example in connection with diaphragm excursion control or limitation. Diaphragm excursion control is useful to prevent the diaphragm and voice coil assembly being driven beyond its maximum allowable peak excursion. Unless proper precautionary measures are taken, powerful amplifiers may force such high levels of drive currents into the voice coil that the diaphragm and voice coil assembly is driven beyond its maximum allowable peak excursion leading to various kinds of mechanical damage. Hence, there is a need to monitor/detect the instantaneous displacement of a loudspeaker diaphragm to prevent mechanical damage caused by excursions exceeding the excursion limit of the type of electrodynamic loudspeaker in question. This issue is of significant importance in numerous areas of loudspeaker technology such as high power loudspeakers for public address systems, automotive speaker and home Hi-Fi applications as well as miniature loudspeakers for portable communication devices such as smartphones, laptop computers etc.

Many attempts have been made in the prior art to detect or estimate instantaneous displacement of loudspeaker diaphragms for the above outlined purposes. These attempts have often been based on complex non-linear models of the particular loudspeaker type in question. Model-based approaches require careful analysis of the electro-mechanical and magnetic characteristics of the particular loudspeaker type of interest. Likewise, model based approaches require complex real-time computations on the non-linear loudspeaker model to estimate the actual excursion of the real operative loudspeaker. Complex computations leads to high power consumption of a Digital Signal Processor executing the model based estimate and/or control algorithm which is particularly undesired for battery powered communication devices like smartphones etc. The model parameters can furthermore be difficult to determine accurately and may vary over temperature, time and between individual loudspeaker samples of the same type. Other attempts have been based on transducer signals supplied by various types of acceleration and velocity sensors attached to the diaphragm or voice coil.

Hence, it is of significant interest and value to provide a relatively simple method for estimating or detecting the displacement or excursion of the loudspeaker diaphragm without relying on complex non-linear models of the particular loudspeaker type. The displacement detection may be accompanied by a suitable mechanism for limiting the diaphragm displacement if it exceeds the loudspeaker's maximum allowable peak excursion. The diaphragm excursion detection mechanism and the corresponding detector should preferably be operative with minimal, or without, a priori knowledge of linear and non-linear properties of the loudspeaker to simplify or entirely eliminate calibration procedures.

EP 2 453 670 A1 discloses a method to generate a control signal that can be used for mechanical loudspeaker protection or for other signal pre-processing functions in a loudspeaker control system without requiring knowledge of the mechanical parameters of the loudspeaker. The control signal may be a measure of how close the loudspeaker is driven to its mechanical displacement limit and is based on a so-called arbitrarily scaled frequency dependent input voltage to excursion transfer function. The latter transfer function is derived during a calibration procedure from a plurality of drive voltage and current measurements on the loudspeaker at different audio frequencies.

U.S. 2009/268918 A1 discloses mechanical protection of loudspeakers using digital processing and predictive estimation of instantaneous displacement of the voice coil in a loudspeaker transducer. The invention solves the problem of limiting the voice coil displacement of the transducer by applying a look-a-head based linear or non-linear predictor and a controller operating directly on the displacement signal in order to finally convert back into the incoming signal domain.

U.S. Pat. No. 5,931,221 B1 discloses with reference to FIG. 7, a dynamic loudspeaker driving apparatus which comprises a power amplifier coupled to an electrodynamic loudspeaker and a feedback circuit for providing improved motional feedback. The feedback circuit negatively feedbacks the detected motional voltage to the power amplifier. A bridge circuit is used to extract a motional voltage produced by the loudspeaker. A leg of the bridge includes an impedance which corresponds to the impedance of the dynamic loudspeaker including its motional impedance so to provide a more accurate motional feedback voltage.

SUMMARY OF THE INVENTION

A first aspect of the invention relates to a method of detecting diaphragm excursion an electrodynamic loudspeaker, comprising steps of:

generating an audio signal for application to a voice coil of the electrodynamic loudspeaker, adding a high-frequency probe signal to the audio signal to generate a composite drive signal, applying the composite drive signal to the voice coil through an output amplifier, detecting a modulation level of a probe signal current flowing through the voice coil.

The skilled person will appreciate that each of the audio signal, high-frequency probe signal, the composite drive signal and the probe signal current may be represented by an analog signal for example as a voltage, current, charge etc. or alternatively be represented by a digital signal, e.g. coded in binary format at a suitable sample rate and resolution.

The present invention provides in one aspect a method of detecting the excursion or displacement of a diaphragm of the electrodynamic loudspeaker which method exploits the excursion dependent change of voice coil inductance of an electrodynamic loudspeaker. This excursion-dependent inductance of the voice coil is reflected in a corresponding excursion-dependent change of the high-frequency impedance of the voice coil of the electrodynamic loudspeaker. This change of high-frequency impedance can be detected during real-time operation of the electrodynamic loudspeaker by adding a preferably inaudible high-frequency probe or pilot signal to the audio signal and detecting the level of modulation of the probe signal current flowing through the voice coil as a result of the high-frequency probe signal component of the composite drive signal applied to the voice coil. The composite drive signal is preferably applied to the voice coil through a suitable output or power amplifier. By detecting the modulation level of the probe signal current, the excursion of the electrodynamic loudspeaker is detectable.

The mechanism behind the excursion-dependent inductance and high-frequency impedance of the voice coil of electrodynamic loudspeakers is discussed in detail below in connection with FIGS. 2 & 3.

The audio signal may comprise speech and/or music supplied from a suitable audio source such as radio, CD player, network player, MP3 player. The audio source may also comprise a microphone generating a real-time microphone signal in response to incoming sound.

The skilled person will understand that the selected frequency of the high-frequency probe signal can vary considerably dependent on impedance characteristics of a specific electrodynamic loudspeaker and various other application constraints. In one exemplary embodiment, the high-frequency probe signal comprises a sine wave with a frequency above 10 kHz, more preferably above 20 kHz. The frequency of the high-frequency probe signal is preferably sufficiently high to be inaudible to the listener or user. The inaudible character of the high-frequency probe signal may either be caused by the probe frequency being above the audible limit of human hearing (i.e. above about 20 kHz) or because the loudspeaker is incapable of reproducing noticeable sound pressure at the probe signal frequency. The frequency of the high-frequency probe signal may accordingly vary considerably; A large diameter woofer may be incapable of producing noticeable sound response above for example 1 kHz such that the high-frequency probe signal may be placed at, or slightly above, 1 kHz for this type of loudspeaker. A small diameter full-range miniature electrodynamic loudspeaker for portable communication devices or music players may on the other hand produce useful sound pressure up to 15 kHz or even 20 kHz such that the high-frequency probe signal preferably is placed at, or slightly above, 20 kHz for this type of loudspeaker to remain inaudible in all situations. Furthermore, the high-frequency probe signal is preferably also located at a frequency range where the voice coil impedance of the loudspeaker exhibits a pronounced inductive behaviour. This is advantageous for level detection accuracy because of the higher modulation of the probe signal current at frequencies where the non-linear voice-coil inductance provides a significant contribution to the total voice-coil impedance.

The skilled person will appreciate that the actual detection of the modulation level of the probe signal current may be accomplished in various ways in either the analog or digital domain. In a preferred embodiment, the detection of the modulation level of the probe signal current comprises steps of:

detecting a composite drive signal current flowing through the voice coil in response to the composite drive signal, band-pass filtering the composite drive signal current to attenuate audio signal components therein, detecting the modulation level of the probe signal current from the band-pass filtered composite drive signal current.

The band-pass filtering of the composite drive signal current may be achieved by band-pass filtering a suitable voltage, current, charge etc. signal proportional to the voice-coil current to produce the probe signal current dependent on the selected voice coil current detection mechanism. The band-pass filtering removes audio signal components from the composite drive signal current and passes substantially only the probe-signal components. Thereafter, the, modulation level of the probe signal current may be detected by extracting an envelope of the composite drive signal current using conventional methods such peak or average detection, and finally detecting modulation of the envelope signal of the probe signal current.

The frequency selective filtering of the composite voice-coil current is preferably adapted to suppress all other frequency components than those proximate to high-frequency probe signal. Large amplitude low frequency components of the audio signal, which tend to determine the excursion of the loudspeaker diaphragm, appear as AM side-bands close to the probe signal frequency and therefore remain largely unattenuated by the frequency selective filtering. Hence, the envelope waveform of the band-pass filtered composite drive signal current reflects the excursion of the diaphragm. Consequently, one embodiment of the present methodology relies on detecting the envelope of the band-pass filtered probe signal current to detect the modulation level. This envelope may be detected by various mechanisms such as traditional AM demodulation techniques. The latter include rectification and low-pass filtering of the band-pass filtered composite drive signal current. In other embodiments, the modulation level of the filtered probe signal current may be detected or estimated by applying suitable bottom and top trackers to the envelope waveform of a digitally converted filtered probe signal current.

The composite drive signal supplied to the voice coil of the electrodynamic loudspeaker may advantageously be pulse modulated to take advantage of the high power-conversion efficiency of pulse modulated amplifiers. This pulse modulation may be accomplished by utilizing a switching type or class D type of output amplifier topology for example PDM or PWM output amplifiers. The latter types of class D amplifiers provide pulse density or pulse width modulation of the audio signal to generate the composite drive signal in modulated format. In the alternative, the output amplifier may comprise traditional non-switched power amplifier topologies like class A or class AB. An output impedance of the power amplifier is preferably smaller than the voice coil impedance of the intended or target loudspeaker(s) throughout the relevant audio frequency range, e.g. 20 Hz to 20 kHz. Hence, the skilled person will appreciate that the output impedance of the output amplifier may vary significantly depending upon impedance characteristics of the target electrodynamic loudspeaker(s) in question. In a number of useful embodiments of the invention, the output impedance of the output amplifier is smaller than 1.0Ω, such as smaller than 0.5Ω or 0.1Ω throughout the relevant audio frequency range. These ranges of relatively small output impedances minimize power dissipation in output devices/transistors of the output amplifier, in particular when coupled to low-impedance electrodynamic loudspeakers, e.g. loudspeakers with nominal impedance in a range between 2 and 8 ohms. The output impedance of the output amplifier is preferably also smaller than 1.0Ω, such as smaller than 0.5Ω, or 0.1Ω, at the frequency of the probe signal.

In numerous useful embodiments of the present methodology, the audio signal may be generated in digital format as a first digital audio signal at a first sample rate. The first sample rate is preferably relatively low such as below 44.1 kHz or below 32 kHz to reduce power consumption of associated digital processing equipment and circuits. However, the use of the above-mentioned class D type of output amplifier topology requires a much higher sampling frequency than first sample rate to provide efficient conversion. Hence, the methodology preferably comprises generating the audio signal as the first digital audio signal at the first sample rate, up-sampling the first digital audio signal to generate a final digital audio signal at a final sample rate higher than the first sample rate. Finally, the final digital audio signal is preferably either pulse density modulated or pulse width modulated in the output amplifier. The final sample rate may be between 4 and 32 times higher than the first sample rate.

The up-sampling of the first digital audio signal to final digital audio signal is preferably performed by one or more intermediate up-sampling stages producing digital audio signals at respective intermediate sample rates in-between the first and the final sample rate.

According to a preferred embodiment of the present methodology, the high-frequency probe signal is generated in digital format as a digital high-frequency probe signal and added to one of the digital audio signals at the intermediate sample rates or to the final digital audio signal to generate a composite drive signal in digital format. In a particularly advantageous variant of the latter embodiment, the high-frequency digital probe signal is added to a digital audio signal with intermediate sample rate at least two times higher than a frequency of the digital high-frequency probe signal. The up-sampling the first digital audio signal to the intermediate sample rate digital audio signal above the Nyquist frequency of the digital high-frequency probe signal before addition of the digital high-frequency probe signal is beneficial in numerous applications. This up-sampling operation allows an audio signal generator supplying the first digital audio signal to operate with a relatively low sampling frequency or rate e.g. 32 kHz despite the use of a relatively high frequency of the digital probe signal such as 40 kHz situated far above the Nyquist frequency of the first digital audio signal. The relatively low sampling frequency of the audio signal generator reduces its power consumption. The up-sampling of the first digital audio signal may for example be accomplished in the above-mentioned modulator portion of the class D amplifier without the expense of additional digital processing hardware and its associated power consumption. The skilled person will appreciate that various types of signal quantisation and noise shaping may be applied to the final digital audio signal and/or to the intermediate digital audio signals in a modulator portion of the class D amplifier.

The present methodology of detecting diaphragm excursion may be configured to limit or control the diaphragm excursion to prevent various kinds of mechanical damage to the loudspeaker. The mechanical damage may be caused by collision between movable loudspeaker components such as the voice coil, diaphragm or voice coil former and stationary components such as the magnetic circuit. In one such embodiment of the present methodology the latter comprises steps of:

comparing the detected modulation level of the probe signal current with a pre-set modulation level criteria such as a modulation level threshold.

This excursion control may be accomplished by a variety of mechanisms for example by attenuating a level of the audio signal if the detected modulation level of the probe signal current matches the pre-set modulation level criteria such as exceeding the modulation level threshold. The attenuation of the audio signal level may be accomplished by selectively attenuating low-frequency components of the digital audio signal, as the latter are more likely to drive the loudspeaker above its excursion limit, or broad band attenuating the entire audio spectrum of the digital audio signal.

The modulation level criteria or threshold may have been determined in numerous ways for example through a previous calibration measurement on the loudspeaker in question. A preferred embodiment of the present methodology comprises steps of:

determining an excursion limit of the electrodynamic loudspeaker during a calibration measurement on the electrodynamic loudspeaker or an electrodynamic loudspeaker of the same type, determining and recording the modulation level of the probe signal current corresponding to the excursion limit of the loudspeaker, deriving the pre-set modulation level criteria from the recorded modulation level of the probe signal current at the excursion limit.

The pre-set modulation level criteria may be stored in digital format in a suitable data memory location of a loudspeaker excursion detector implementing the present diaphragm excursion detection. Alternatively, the pre-set modulation level criteria may be stored in data memory of a signal processor, such as a microprocessor or DSP operatively coupled to the loudspeaker excursion detector as described below in additional detail.

In one embodiment, the high-frequency probe signal is added to the audio signal as an integral operation of a pulse modulation of the audio signal in a class D output amplifier. Hence, the high-frequency probe signal may be added to the audio signal by modulating the audio signal with a predetermined carrier frequency in a pulse modulated output amplifier such that the high-frequency probe signal is produced by carrier frequency components. The high-frequency probe signal therefore comprises the carrier frequency component of the pulse modulation. This type of carrier frequency components are inherently added to the drive signal supplied to the loudspeaker by class D output amplifiers despite certain output filters which may attenuate the level of these carrier frequency components. While this carrier frequency component is unwanted under many circumstances, this particular embodiment exploits the presence of the carrier frequency component to eliminate separate high-frequency probe signal generation. Hence, a separate digital or analog probe signal generator and corresponding signal combiner are both saved leading to a reduction of the complexity of the present loudspeaker excursion detector and corresponding methodology.

The addition of the high-frequency probe signal to the audio signal may be performed substantially continuously during operation of the diaphragm excursion detection methodology or discontinuously for example solely during time periods where certain characteristics of the audio signal are met. According to a preferred embodiment, the methodology comprises steps of:

comparing the level of the audio signal with a predetermined threshold level, adding the high-frequency probe signal to the audio signal exclusively when the level of the audio signal exceeds the predetermined threshold level.

Hence, when the level of the audio signal falls below the predetermined threshold level the addition of the high-frequency probe signal may be interrupted. In this embodiment, the predetermined threshold level ensures the high-frequency probe signal is added only to the audio signal under conditions where the audio signal has sufficient level or amplitude to force the loudspeaker diaphragm close to, or above, its excursion limit. The interruption of the high-frequency probe signal may serve to minimise possible audible artifacts associated with the high-frequency probe signal, in particular if the high-frequency probe signal is placed in the audible frequency range. In the alternative, the level of the high-frequency probe signal may be attenuated with a certain factor e.g. 20 dB or more when the level of the audio signal falls below the predetermined threshold level.

As previously mentioned, the present methodology may advantageously be performed at least partly in the digital domain. In one embodiment, the probe signal current is sampled by an A/D converter to provide a sampled or digital probe signal current. The presence of the probe signal current in the digital domain is of course particularly well-suited for detection of the modulation level by a DSP algorithm or application executing on the previously discussed signal processor. The skilled person will appreciate that the probe signal current may be represented by any suitable voltage, current or charge signal proportional thereto.

A second aspect of the invention relates to a loudspeaker excursion detector for electrodynamic loudspeakers, comprising:

an audio signal input for receipt of an audio signal supplied by an audio signal source, a probe signal source for generation of a high-frequency probe signal, a signal combiner configured to combine the audio signal with the high-frequency probe signal to provide a composite drive signal, an output amplifier configured to supply the composite drive signal at a pair of output terminals connectable to a voice coil of an electrodynamic loudspeaker, a current detector configured for detecting a composite drive signal current flowing through the voice coil in response to the application of the composite drive signal, a modulation detector configured to determine a modulation level of a probe signal current of the composite drive signal current.

The properties of the output amplifier have been disclosed in detail above in connection with the corresponding excursion detection methodology. The Class D output amplifier may comprises a half-bridge driver stage with a single output coupled to the electrodynamic loudspeaker or a full-bridge/H-bridge driver stage with the pair of output terminals coupled to respective sides or terminals of the electrodynamic loudspeaker.

The skilled person will appreciate that the current detector may comprise various types of current sensors for example a current mirror connected to an output transistor of the output amplifier or a small sense resistor coupled in series with the loudspeaker voice coil. The composite drive signal current may accordingly be represented by a proportional/scaled sense voltage. The latter voltage may be sampled by the previously discussed A/D converter to allow processing and modulation detection of the probe signal current in the digital domain. The loudspeaker excursion detector preferably comprises a band-pass filter coupled for receipt of the composite drive signal current and providing the probe signal current at a filter output as discussed in detail above in connection with the corresponding feature of the excursion detection methodology.

A preferred embodiment of the modulation detector comprises an envelope detector coupled to the output of one of a band-pass filter to detect the modulation level of the probe signal current. The envelope detector may comprise an AM demodulator and operate either in the digital domain or analog domain as discussed in detail above in connection with the corresponding feature of the excursion detection methodology.

The loudspeaker excursion detector may comprise a diaphragm excursion limiter to control and/or limit diaphragm excursion to prevent mechanical damage as discussed in detail above in connection with the corresponding feature of the excursion detection methodology. The diaphragm excursion limiter may comprise a comparator configured for comparing the detected modulation level of the probe signal current with a pre-set modulation level criteria such as a modulation level threshold for the previously discussed reasons. The diaphragm excursion limiter is preferably configured to attenuate the level of the audio signal if the detected modulation level of the probe signal current matches the pre-set modulation level criteria—for example exceeds the modulation level threshold.

The audio signal source and the probe signal source may be configured to supply the audio signal and the high-frequency probe signal, respectively, in digital format to provide a digital composite drive signal at a first sample rate to an input of the pulse density modulated or pulse width modulated power stage.

According to a preferred embodiment, the output amplifier comprises a digital up-sampling circuit configured for receipt and up-sampling the first digital audio signal to a final digital audio signal at a final sample rate, higher than the first sample rate, to generate a digital composite drive signal. The digital up-sampling circuit comprises one or more intermediate up-sampling stages configured to produce one or more digital audio signal(s) at respective intermediate sample rate(s) in-between the first sample rate and the final sample rate. In a particularly advantageous embodiment of the present loudspeaker excursion detector the probe signal source is configured to generating the high-frequency probe signal as a digital high-frequency probe signal and the digital up-sampling circuit comprises a digital signal combiner configured to add the digital high-frequency probe signal to a digital audio signal at an intermediate sample rate at least two times higher than a frequency of the digital high-frequency probe signal. The advantages offered by this embodiment of the invention have previously been described in detail in connection with the first aspect of the invention.

The final digital audio signal may be applied directly or indirectly to an input of the previously discussed pulse modulated output amplifier e.g. a class D amplifier.

A third aspect of the invention relates to a semiconductor substrate or die having an loudspeaker excursion detector according to any of the above-described embodiments integrated thereon. The semiconductor substrate may be fabricated in a suitable CMOS or DMOS semiconductor process.

A fourth aspect of the invention relates to an excursion control system for electrodynamic loudspeaker. The excursion control system comprising:

an electrodynamic loudspeaker comprising a movable diaphragm assembly for generating audible sound in response to actuation of the assembly, a loudspeaker excursion detector, according to according to any of the above-described embodiments thereof, electrically coupled to the movable diaphragm assembly.

The excursion control system furthermore comprises an audio signal source which is operatively coupled to the audio signal input of the loudspeaker excursion detector. The audio signal source may comprise a programmable or hard-wired Digital Signal Processor (DSP) operating inter alia as a digital audio signal source for the present loudspeaker excursion detector. The digital audio signal supplied by the programmable or hard-wired DSP may be generated by the DSP itself or retrieved from an audio file stored in a readable data memory coupled to the excursion control system. The digital audio signal may comprise a real-time digital audio signal supplied to a DSP audio input from an external digital audio source such as a digital microphone. The real-time digital audio signal may be formatted according to a standardized serial data communication protocol such as IIC or SPI, or formatted according to a digital audio protocol such as $I^2S$, SPDIF etc.

The present excursion control system may advantageously function as a self-contained audio delivery system with integral loudspeaker excursion detection and control that can operate independently of any particular environment and application processor to provide reliable and convenient protection against excursion induced mechanical damage of the electrodynamic loudspeaker.

BRIEF DESCRIPTION OF THE DRAWINGS

Preferred embodiments of the invention will be described in more detail in connection with the appended drawings, in which.

DETAILED DESCRIPTION OF PREFERRED EMBODIMENTS

Figure 1:
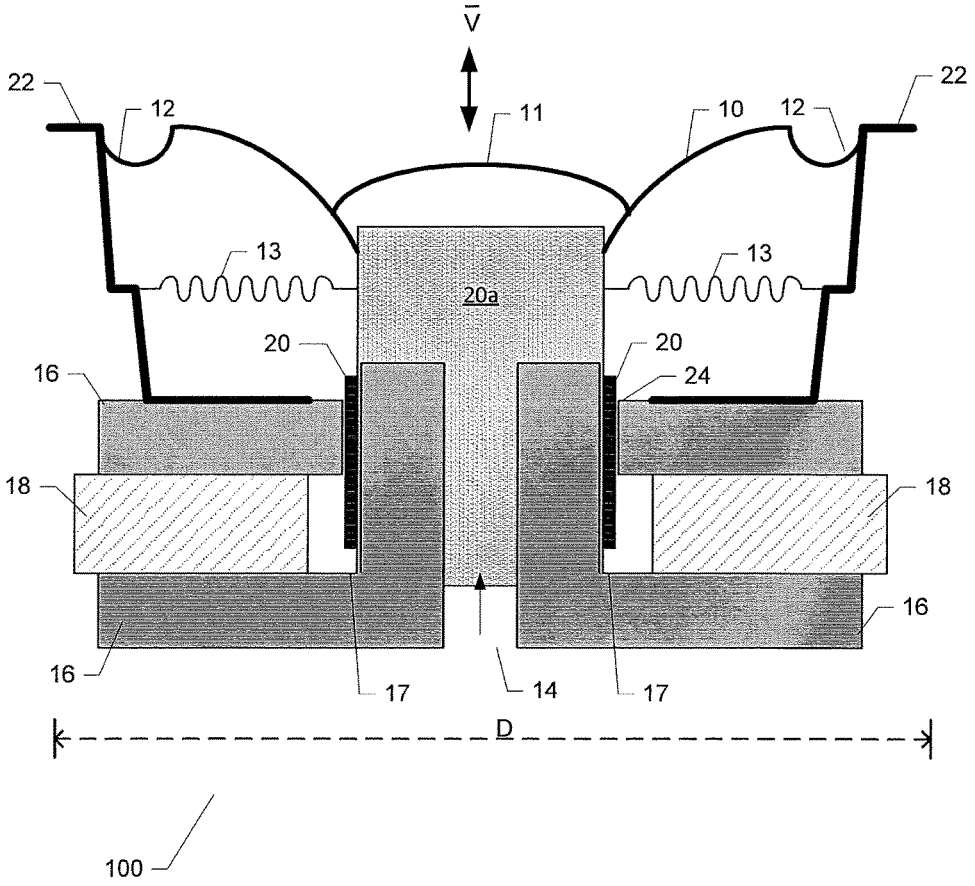
FIG. 1 is a schematic cross-sectional view of a 6.5" electrodynamic loudspeaker for various sound reproducing applications suitable for use in the present invention.

FIG. 1 is a schematic illustration of a typical electrodynamic loudspeaker 100 for use in various types of audio applications. The skilled person will appreciate that electrodynamic loudspeakers exist in numerous shapes and sizes dependent on the intended type of application. The electrodynamic loudspeaker 100 used in the below described methodologies and devices for loudspeaker excursion detection and control has a diaphragm diameter, D, of approximately 6.5 inches, but the skilled person will appreciate that the present invention is applicable to virtually all types of electrodynamic loudspeakers, in particular to miniature electrodynamic loudspeaker for sound reproduction in portable terminals such as mobile phones, smartphones and other portable music playing equipment. The maximum outer dimension D such miniature electrodynamic loudspeakers may lie between 6 mm and 30 mm.

The electrodynamic loudspeaker 100 comprises a diaphragm 10 fastened to a voice coil former 20*a*. A voice coil 20 is wound around the voice coil former 20*a* and rigidly attached thereto. The diaphragm 10 is also mechanically coupled to a speaker frame 22 through a resilient edge or outer suspension 12. An annular permanent magnet structure 18 generates a magnetic flux which is conducted through a magnetically permeable structure 16 having a circular air gap 24 arranged therein. A circular ventilation duct 14 is arranged in a center of the magnetically permeable structure 16. The duct 14 may be used to conduct heat away from an otherwise sealed chamber situated beneath the diaphragm 10 and dust cap 11. A flexible inner suspension 13 is also attached to the voice coil former 20*a*. The flexible inner suspension 13 serves to align or center the position of the voice coil 20 in the air gap 24. The flexible inner suspension 13 and resilient edge suspension 12 cooperate to provide relatively well-defined compliance of the movable diaphragm assembly (voice coil 20, voice coil former 20*a* and diaphragm 10). Each of the flexible inner suspension 13 and resilient edge suspension 12 may serve to limit maximum excursion or maximum displacement of the movable diaphragm assembly.

During operation of the loudspeaker 100, a drive signal voltage is applied to the voice coil 20 of the loudspeaker 100. A corresponding voice coil current is induced in response leading to essentially uniform vibratory motion, in a piston range of the loudspeaker, of the diaphragm assembly in the direction indicated by the velocity arrow V. Thereby, a corresponding sound pressure is generated by the loudspeaker 100. The vibratory motion of the voice coil 20 and diaphragm 10 in response to the flow of voice coil current is caused by the presence of a radially-oriented magnetic field in the air gap 24. The applied coil current and voltage lead to power dissipation in the voice coil 20 which heats the voice coil during operation. Consequently, prolonged application of too high drive voltage/current may lead to overheating of the voice coil which is a common cause of failure or irreversible damage in electrodynamic speakers. The application of excessively large voice coil currents which force the movable diaphragm assembly beyond its maximum allowable excursion limit is another common fault mechanism in electrodynamic loudspeakers leading to various kinds of irreversible mechanical damage. One type of mechanical damage may for example be caused by collision between the lowermost edge of the voice coil 20 and an annular facing portion 17 of the magnetically permeable structure 16.

A significant source of non-linearity of the loudspeaker 100 is caused by the excursion or displacement dependent length of voice coil wire placed in the magnetic field inside the magnetic gap 24. From the schematic illustration of the loudspeaker 100 it is evident that the length of voice coil wire arranged in proximity to the magnetically permeable structure 16 tends to decrease for large positive (upwards) excursion and increase for large negative excursions of the voice coil 20. Due to this variation of the amount of magnetically permeable material close to the voice coil with voice coil/diaphragm excursion, the inductance of the voice coil 20 exhibits a similar excursion dependent variation which is utilized in the present invention as explained in further detail below.

Figure 2:
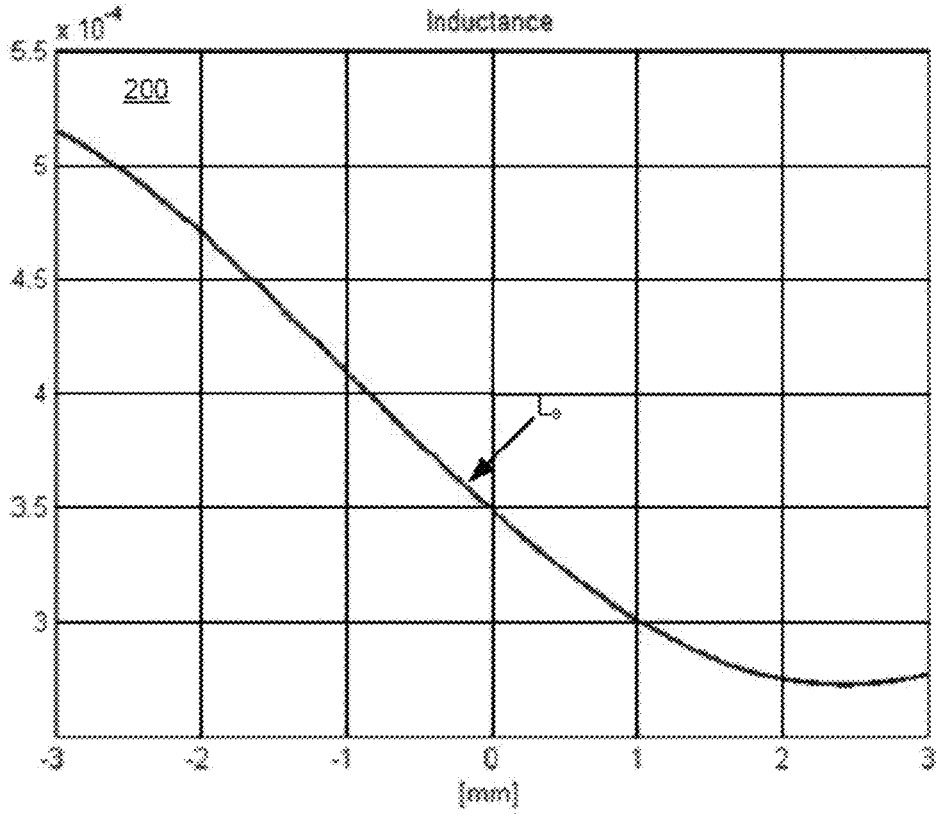
FIG. 2 shows an experimentally measured plot of voice coil inductance versus diaphragm excursion for the 6.5" electrodynamic loudspeaker.

FIG. 2 shows an experimentally measured plot 200 of voice coil inductance, $L_e$, of the 6.5" electrodynamic loudspeaker 100 discussed above versus diaphragm excursion. The measured voice coil inductance is indicated in Henry along the y-axis of the graph 2 and the diaphragm excursion from its quiescent position in mm is indicated on the x-axis. The quiescent position of the diaphragm (and hence of voice coil assembly) corresponds to x=0. The pronounced lack of symmetry in the inductance curve on either side of the quiescent position is evident. The inductance increases for negative displacement (inward) and decreases for positive displacement (outward). This lack of symmetry is caused by the markedly asymmetric geometry of the magnetic circuit adjacent to the air gap 24.

Figure 3:
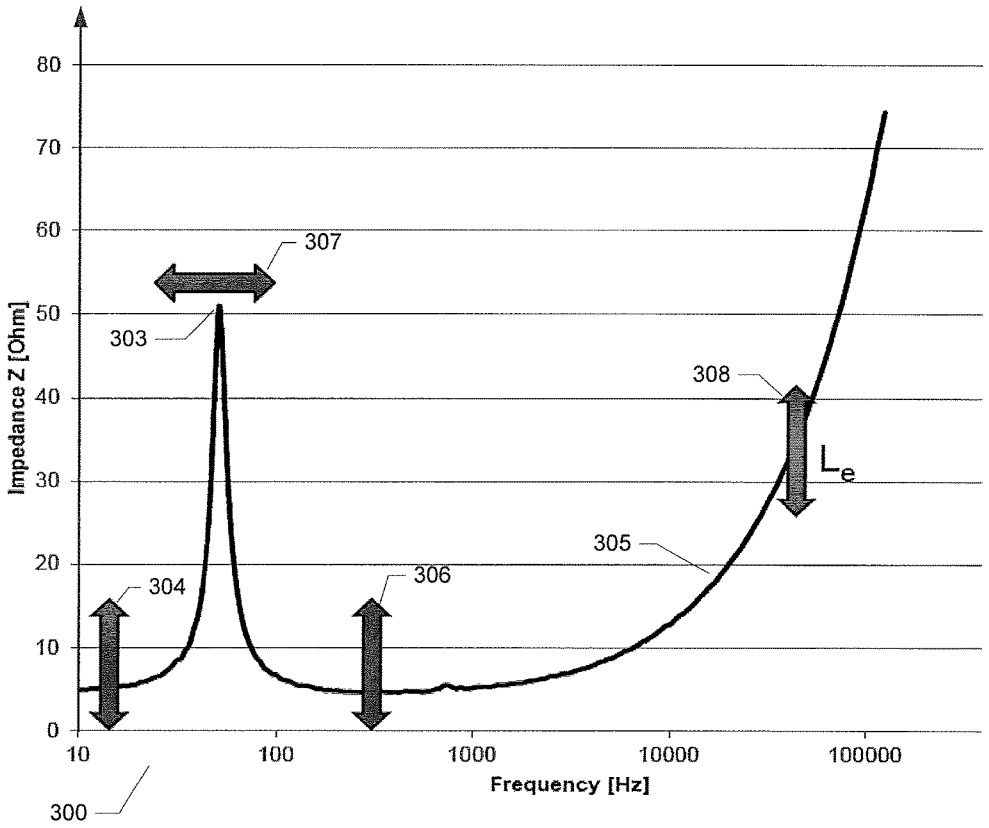
FIG. 3 shows measured voice coil impedance versus frequency for the electrodynamic loudspeaker illustrated on FIG. 1 above.

FIG. 3 shows a measured impedance curve 305 for the 6.5" electrodynamic loudspeaker discussed above across a frequency range from 10 Hz to about 100 kHz. The loudspeaker may produce useful sound pressure in a certain sub-range such as a frequency range between about 50 Hz and 10 kHz depending on amongst other factors, dimensions of the loudspeaker enclosure and shape of the loudspeaker diaphragm. A DC resistance of the voice coil of the loudspeaker is approximately 3.5Ω as evidenced by the measured 10 Hz impedance. The low-frequency or natural resonance frequency of the loudspeaker is located approximately at 50 Hz where the impedance 303 reaches a low-frequency peak value of about 50Ω. Above the natural resonance frequency of the loudspeaker, the loudspeaker impedance curve 305 exhibits a constantly rising impedance which is particularly pronounced for frequencies above approximately 3 kHz. This rise of impedance is caused by inductance of the voice coil and continues to frequencies well above 100 kHz for the loudspeaker under examination. The vertical arrow 308 illustrates the non-linear excursion/displacement dependence of the voice coil impedance at high frequencies caused by the previously explained excursion dependent change variation of the voice coil inductance $L_e$. The influence of the excursion dependent change of the voice coil inductance on the voice coil impedance becomes particularly pronounced at high frequencies because the voice coil inductance $L_e$ tends to dominate the voice coil impedance in this frequency region.

The vertical arrows 304, 306 illustrate the influence on the impedance curve 305 of a temperature dependent variation of the DC resistance of the voice coil. Finally, the horizontal arrow 307 illustrates a temperature and excursion/displacement dependent variation of the natural resonance frequency of the loudspeaker 100 due to a change in suspension compliance.

Figure 4:
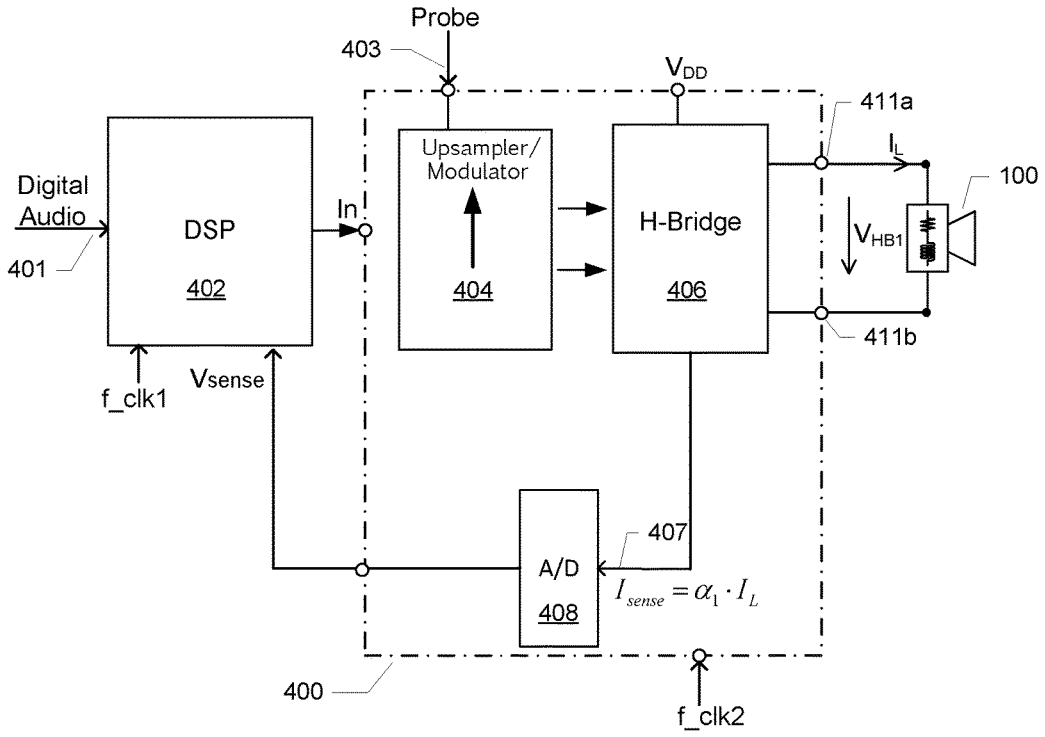
FIG. 4 is a schematic block diagram of a loudspeaker excursion detector for electrodynamic loudspeakers in accordance with a first embodiment of the invention, FIG. 5A) shows a composite drive signal applied to the voice coil of the electrodynamic loudspeaker by the loudspeaker excursion detector of FIG. 3 above, FIG. 5B) shows a measured filtered voice coil current waveform of the electrodynamic loudspeaker in response to the application of composite drive signal illustrated above on FIG. 5A)

The pronounced variation of voice coil impedance with diaphragm displacement at high frequencies is exploited by the present invention to detect the excursion of the diaphragm and voice coil assembly. The variation of the voice coil impedance is measured at a selected frequency by adding a high-frequency probe tone to the ordinary audio signal (e.g. speech and/or music) and form a composite drive signal which is applied to the voice coil of the loudspeaker through a suitable low output impedance power amplifier such as an analog or digital class D power amplifier. By detecting the degree or level of modulation of the probe signal current flowing through the voice coil in response to the application of the composite drive signal, it is possible to detect the excursion of the diaphragm and voice coil as explained in further detail below FIG. 4 shows a schematic block diagram of a loudspeaker excursion detector 300 in accordance with a first embodiment of the invention coupled to the electrodynamic loudspeaker 100 discussed above through a pair of externally accessible speaker terminals 411*a*, 411*b*. In the present embodiment, the loudspeaker excursion detector 300 operates in the digital domain, but other embodiments may instead use analog signals or a mixture of analog and digital signals. The loudspeaker excursion detector 300 comprises an audio signal input, In, for receipt of a digital audio signal supplied by a Digital Signal Processor (DSP) 302. Hence, the DSP 302 functions inter alia as a digital audio signal source of the present loudspeaker excursion detector 400. The digital audio signal supplied by the DSP 402 may be generated by the DSP itself or derived from an external digital audio source, for example a digital microphone, and supplied to the DSP 402 through the audio input 401. An externally generated digital audio signal may be formatted according to a standardized serial data communication protocol such as IIC or SPI, or formatted according to a digital audio protocol such as IIS, SPDIF etc. The loudspeaker excursion detector 400 is supplied with operating power from a positive power supply voltage $V_{DD}$. Ground (not shown) or a negative DC voltage may form a negative supply voltage for the loudspeaker excursion detector 400. The DC voltage of $V_{DD}$ may vary considerably depending on the particular application of the loudspeaker excursion detector 400 and may typically be set to a voltage between 1.5 Volt and 100.0 Volt.

The skilled person will appreciate that the illustrated loudspeaker excursion detector 400, the DSP 402 and the loudspeaker 100 may form part of a complete excursion control system for the electrodynamic loudspeaker 100. In particular, the DSP 402 and loudspeaker excursion detector 400 may be integrated on a common semiconductor substrate connectable to the loudspeaker 100 through the illustrated pair of externally accessible speaker terminals 411*a*, 411*b*. The DSP 402 is configured to internally process digital signals by a sampling frequency of 48 kHz derived from the external DSP clock input, f_clk1. The external DSP clock input, f_clk1 may be set to a clock frequency between 10 MHz and 100 MHz. The sampling frequency may be selected to other frequencies such as a frequency between 16 kHz and 192 kHz, in other embodiments of the invention depending on factors like desired audio bandwidth and other performance characteristics of a particular application. The digital audio signal supplied by the DSP 402 to the input of the loudspeaker excursion detector 400 has a sampling frequency of 48 kHz. The loudspeaker excursion detector comprises a probe signal source (not shown) generating and supplying the previously discussed high-frequency probe signal in digital format to the loudspeaker excursion detector 400 through terminal 403. The probe signal may either by generated by the DSP 402 at the same sample rate as the digital audio input signal or by an independent digital probe signal source or generator with another sample rate.

The loudspeaker excursion detector 400 comprises a digital PWM output amplifier comprising a composite upsampler and modulator 404 coupled to an H-bridge output stage 406. The H-bridge output stage supplies the composite drive signal in a pulse width modulated format to the loudspeaker 100 through the pair of output terminals 411*a*, 411*b*. The digital PWM output amplifier is configured to exhibit an output impedance, at the pair of output terminals, that is significantly lower than the impedance of the driven loudspeaker 100 at the frequency of the digital probe signal to provide essentially constant voltage drive to the loudspeaker 100 for reasons discussed below in further detail. The output impedance of the digital PWM output amplifier at the probe signal frequency may be less than 1.0Ω, even more preferably less than 0.5Ω, such as less than 0.1Ω.

The loudspeaker excursion detector 400 additionally comprises a current detector schematically illustrated by the arrow $I_{sense}$ 407 that detects a composite drive signal current $I_L$ flowing through the voice coil of the loudspeaker 100 in response to the application of the composite drive signal by the digital PWM output amplifier to the loudspeaker 100. The skilled person will appreciate that the current detector may comprise various types of current sensors that generate a voltage, current or charge signal proportional to the composite drive signal current in the voice coil for example a current mirror connected to an output transistor of the H-bridge 406 or a small sense resistor coupled in series with the loudspeaker 100. The composite drive signal current $I_L$ may accordingly be represented by a proportional/scaled sense voltage which is applied to the input of the analog-to-digital converter 408. The analog-to-digital converter 408 is adapted to digitize the measured sense voltage and provide a digital sense voltage or sense data at a sample rate fixed by the analog-to-digital converter 408 to a suitable input port of the DSP 402. The resolution of the analog-to-digital converter 408 may vary depending on how accurate value of the sense voltage has to be represented. In numerous applications, the resolution may fall between 8 and 24 bits. In one embodiment, the sampling frequency of the analog-to-digital converter 408 is set to a frequency at least two times higher than the frequency of the digital probe signal to ensure accurate representation thereof without aliasing errors. In the present embodiment with a probe signal frequency around 40 kHz this requirement means the sampling frequency of the converter 408 should be larger than 80 kHz for example 96 kHz. However, according to an alternative embodiment of the invention, the sampling frequency of the converter 408 is synchronized with the digital probe signal such that the digital output of converter 408 can be digitally processed to directly down convert or transpose the spectral content of the composite drive signal current from the probe frequency to DC. This direct down conversion leaves the envelope portion of the composite drive signal current centred around DC. This embodiment of the present loudspeaker excursion detector 400 allows the use of a digital lowpass filter instead of the previously discussed analog or digital band-pass filter to extract the probe signal current. Another advantage of this embodiment is that it allows the use of a digital decimation circuit or stage after the digital lowpass filter to reduce the sample-rate resulting in lower digital power consumption and lower MIPs requirements of the DSP 402.

The DSP 402 preferably comprises a software programmable DSP core controlled by executable program instructions such that each signal processing function may be implemented by a particular set of executable program instructions. However, the skilled person will understand that the DSP 402 in the alternative may be essentially hard-wired such that each signal processing function is implemented by a particular collection of appropriately configured combinatorial and/or sequential logic circuitry.

The DSP 402 comprises a software or custom hardware implemented modulation detector (not shown) configured to determine the modulation level of the probe signal current of the composite drive signal current $I_L$ represented by the proportional digital sense voltage transmitted $V_{sense}$ to the input port of the DSP 402. As explained above, the modulation detector is preferably implemented as a set of executable program instructions. The detection of the modulation level of the probe signal current is explained in further detail below in connection with the illustration of experimentally measured waveforms of the composite drive signal current $I_L$ in the loudspeaker 100.

As explained above, the digital probe signal is added to the digital audio signal inside the composite up-sampler and modulator 404, rather than inside the DSP 402, which leads to certain benefits in many embodiments of the invention. The digital probe signal has a frequency of about 40 kHz in the present embodiment due to the particular high-frequency impedance characteristics of the loudspeaker 100. However, since the DSP 402 uses the previously discussed internal sampling rate of 48 kHz for representation of digital audio signals, the frequency of the probe signal lies above the Nyquist frequency of the DSP 402 making the DSP incapable of accurately representing and manipulating the digital probe signal. While one solution to this problem would be to use a higher sampling rate for the internal digital audio signals of the DSP 402, this solution is undesirable in some embodiments because of the accompanying increase of power consumption. This problem has been solved in an advantageous manner in the present embodiment by adding the digital probe signal to an existing intermediate digital audio signal at an intermediate sample rate inside the composite up-sampler and modulator 404. The skilled person will understand the up-sampler or up-sampling circuit may be configured to increase the 48 kHz sampling rate of the digital audio signal by a predetermined integer or non-integer factor, for example a factor between 4 and 32, by one or more intermediate up-sampling stages to produce the intermediate digital audio signal. According to a preferred embodiment of the invention, the digital audio signal is up-sampled in one or more cascaded stages providing the intermediate digital audio signals at their respective intermediate sample rates. In one exemplary embodiment, the up-sampling circuit is configured for 8:1 up-sampling (factor 8) and comprises of three cascaded 2:1 up-sampling stages or operations. The digital high-frequency probe signal may be added at any up-sampling stage where the intermediate or local sample rate meets the Nyquist condition for the chosen probe signal frequency. The composite drive signal is therefore generated inside the composite up-sampler and modulator 404 by adding the digital probe signal to a selected intermediate digital audio signal at an intermediate sample rate. The skilled person will appreciate that various types of audio signal quantisation and noise shaping of the composite drive signal may be applied in the modulator portion to form a final pulse width modulated drive signal applied to the inputs of the H-bridge 406.

Finally, the skilled person will understand that the digital probe signal may be added to the digital audio signal inside the DSP 402 in alternative embodiments of the invention. This is particularly of interest if the chosen internal signal sampling rate of the DSP 402 from the onset is more than two times higher than the intended frequency of the digital high-frequency probe signal or in situations where an increase of the internal signal sampling rate to accommodate the digital high-frequency probe signal digital is acceptable.

Figure 5:
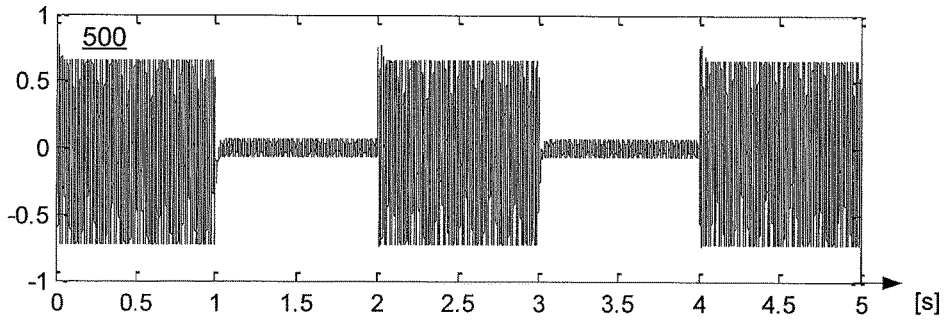
Figure 5:
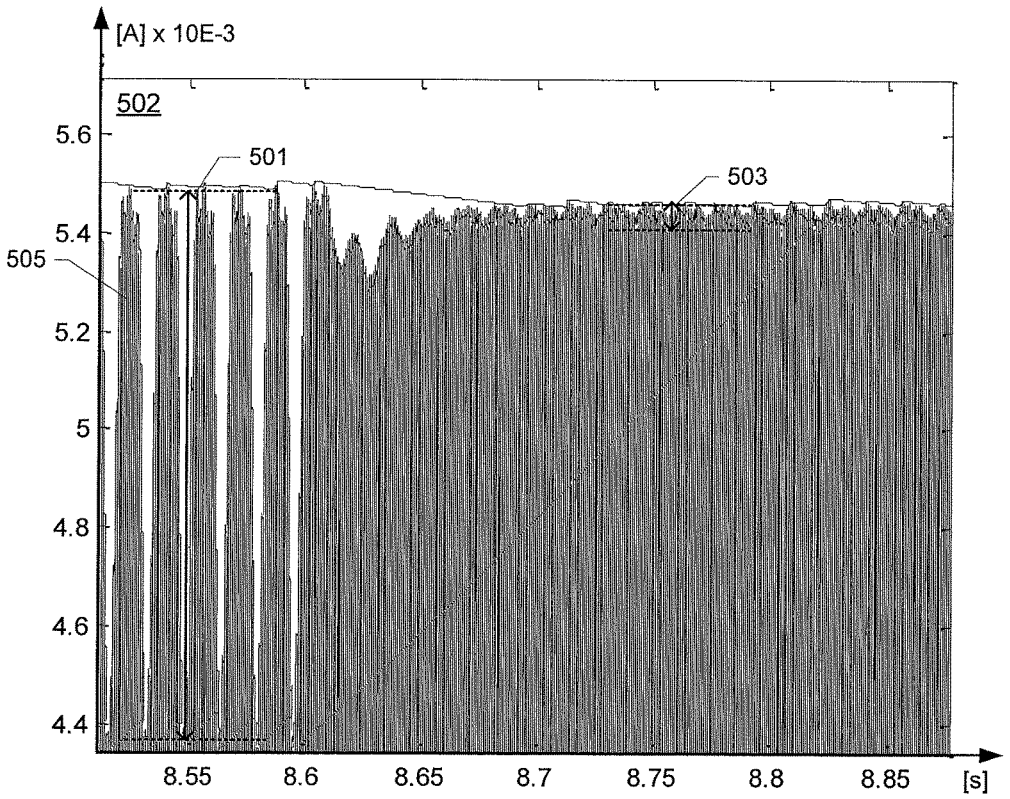

The waveform graph 500 of FIG. 5A) shows a composite drive signal applied to the voice coil of the electrodynamic loudspeaker 100 through the pair of externally accessible speaker terminals 411*a*, 411*b* of the loudspeaker excursion detector of FIG. 4 above. The composite drive signal comprises an alternately small/large 60 Hz signal component, which simulates a variable level of a low-frequency audio signal, and a constant amplitude high-frequency probe signal of 40 kHz. The small level time periods of the 60 Hz signal leads to low excursion of the movable voice coil assembly and hence relatively constant value of the voice coil inductance $L_e$ as explained in connection with FIGS. 2 & 3 above. On the other hand, the time periods where the 60 Hz component of the composite drive signal has a high level leads to large excursion of the movable voice coil assembly and hence relatively large excursion dependent change of the voice coil inductance $L_e$ as explained in connection with 2 above.

The output impedance of the loudspeaker excursion detector 500 at 40 kHz is significantly smaller than the 32Ω@ 40 kHz impedance of the loudspeaker 100 (refer to the impedance curve 505 depicted on FIG. 3). The 40 kHz output impedance of the loudspeaker excursion detector 500 may for example lie below 1.0Ω such that a substantially constant level of the composite drive signal drive voltage is applied to the loudspeaker voice coil independent of the previously described variable high-frequency impedance of the loudspeaker caused by the excursion dependent change of the voice coil inductance $L_e$.

The voltage drive of the voice coil of the loudspeaker at the 40 kHz probe frequency leads to a pronounced variable probe signal current through the voice coil if the 40 kHz impedance of the voice coil changes with loudspeaker excursion, i.e. at large excursion of the movable diaphragm and voice coil assembly as explained above. Under the opposite condition, at small excursions of the movable diaphragm and voice coil assembly, the constant voltage drive of the voice at the 40 kHz probe frequency leads to a substantially constant probe signal current through the voice coil because the 40 kHz impedance of the voice coil remains largely constant independent of the loudspeaker excursion.

This phenomenon is illustrated on graph 502 which shows a band-pass-filtered voice-coil current waveform 505 zoomed in time around a high level to low level transition of the 60 Hz component of the audio drive signal. The filtered voice coil current waveform 505 has been obtained by filtering by a band-pass filter centred at the probe signal frequency of 40 kHz. The depicted filtered voice coil current waveform evidently displays a high level of modulation, as indicated by arrow 501 tracking top and bottom of the envelope of the filtered voice coil current waveform, when the level of the 60 Hz drive signal component is large, i.e. from t=8.5 s to 8.6 s. The maximum and minimum amplitude of the filtered probe signal current in this region correspond to the maximum and minimum values of the 60 Hz input signal. Conversely, a low level modulation, as indicated by arrow 503, is evident under low level conditions of the 60 Hz drive signal component from t=8.6 s to 8.85 s. Hence, by detecting the envelope modulation of the filtered voice coil current waveform, the displacement of the movable diaphragm assembly can be detected. The skilled person will appreciate that the actual detection of the modulation level of the probe signal current may be accomplished in various ways in either the analog or digital domain for example by traditional AM demodulation techniques including signal rectification and low-pass filtering. In other embodiments, the modulation level of the probe signal current may be detected or estimated by applying suitable bottom and top trackers to the filtered voice coil current waveform of graph 502. This may be accomplished in the digital domain by a suitable software function executed by the DSP 402 (refer to FIG. 4) operating on a digitized version of the probe signal current waveform supplied by the analogue-to-digital converter 508.

The DSP 402 may in addition to the above outlined detection of the diaphragm/voice coil excursion in addition be configured to limit or control the diaphragm excursion. This excursion control may be accomplished by a variety of mechanisms. In one embodiment a maximum allowable excursion of the electrodynamic loudspeaker is determined during a calibration measurement on the electrodynamic loudspeaker or an electrodynamic loudspeaker of the same type. The modulation level of the probe signal current corresponding to the maximum allowable excursion is recorded as a maximum modulation threshold or similar modulation level criteria. During subsequent operation of the loudspeaker excursion detector 400, the instantaneous modulation level of the probe signal current is compared to the maximum modulation threshold by a suitably configured software/program routine running on the DSP 402. If the instantaneous modulation level of the probe signal current exceeds the maximum modulation threshold, the DSP 402 in response attenuates the level of the digital audio input signal to the loudspeaker excursion detector 400 for example by selectively attenuating low-frequency components of the digital audio input signal (which are more likely to drive the loudspeaker above its maximum allowable excursion limit) or broad band attenuating the entire spectrum of the digital audio input signal.

Finally, the skilled person will understand that the frequency of the high-frequency probe signal can deviate considerably from the 40 kHz frequency utilised in the present embodiment dependent on impedance characteristics of the specific electrodynamic loudspeaker. Furthermore, the frequency of the high-frequency probe signal should preferably be sufficiently high to render it inaudible either because the frequency lies above the audible band of human hearing (i.e. above 20 kHz) or because the loudspeaker is incapable of reproducing noticeable sound pressure at the probe signal frequency. The selection of probe signal frequency may accordingly vary considerably depending on acoustic and electrical characteristics of the loudspeaker type in question; A large diameter woofer may produce no sound response above for example 1 kHz such that the high-frequency probe signal may be placed at, or slightly above, 1 kHz for this type of loudspeaker. A small diameter full-range miniature electrodynamic loudspeaker for portable communication devices or music players may on the other hand produce significant sound pressure up to 15 kHz or even 20 kHz such that the high-frequency probe signal preferably should be placed at, or slightly above, 20 kHz for this type of loudspeaker to remain inaudible. Furthermore, the high-frequency probe signal is preferably also located in a frequency range where the voice coil impedance of the loudspeaker exhibits a pronounced inductive behaviour. This is preferred because the excursion detection methodology and devices are based on the above described excursion dependent behaviour of the voice coil inductance $L_e$.

Figure 6:
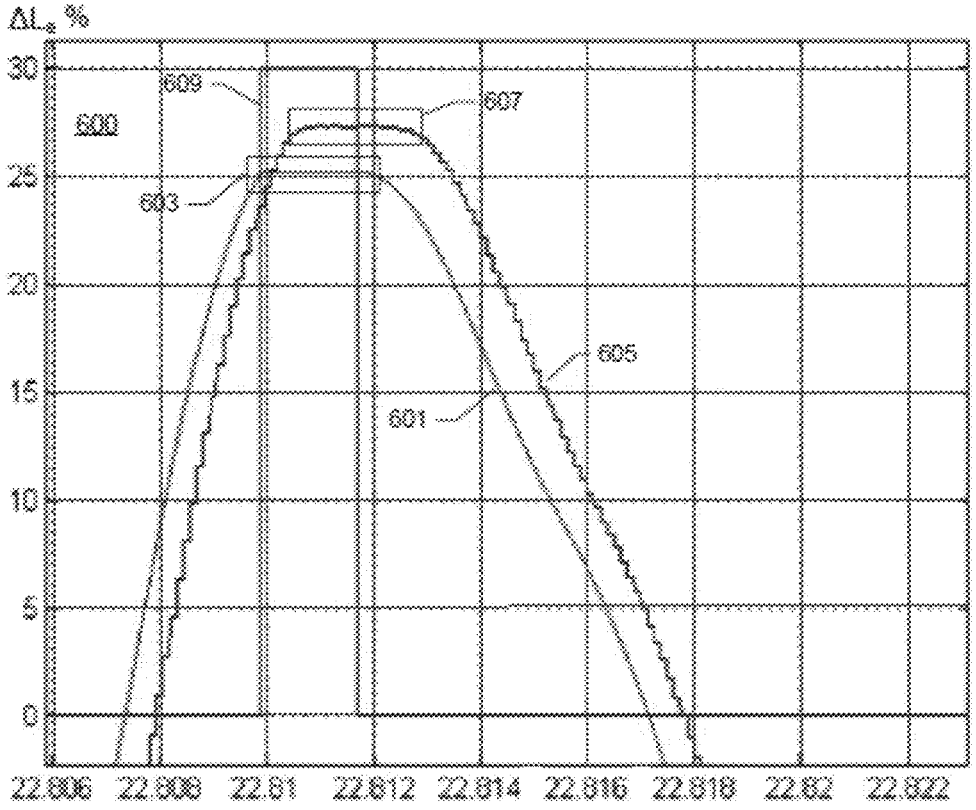
FIG. 6 shows a time-zoomed portion of the filtered voice coil current waveform displayed on FIG. 5B) above.

FIG. 6 shows a time-zoomed simulation of the filtered voice coil current waveform corresponding to the measured waveform 505 of graph 502, but for a condition where the movable diaphragm assembly has been blocked from further excursion for example by mechanical contact with a magnetic circuit structure of the loudspeaker. With reference to FIG. 1, this situation corresponds to the discussed collision between the lowermost edge of the voice coil 20 and the annular facing portion 17 of the magnetically permeable structure 16. The present inventors have determined that certain features of the filtered voice coil current waveform are highly useful to detect that the movable diaphragm assembly of the loudspeaker has reached or exceeded its maximum allowable excursion, or excursion limit. Hence, mechanical damage of the voice coil is a likely result unless precautionary measures are taken to limit the excursion. The fact that this determination can be made from the filtered voice coil current waveform itself without any a priori knowledge of linear and non-linear properties of the loudspeaker in question is highly useful. This feature may eliminate the need for individual calibration of the previously discussed excursion control system to the connected electrodynamic loudspeaker.

The displayed segment of the filtered voice coil current waveform on graph 600 is centred around a single peak of the envelope of the filtered voice coil current waveform. The displayed voice coil current waveform 605 comprises a substantially flat peak plateau as indicated by the dotted box 607. The simulated change of the voice coil inductance in percentage is indicated by curve 601 along the y-axis. Curve 601 also displays a substantially flat peak plateau as indicated by the dotted box 603. The abrupt stop to the excursion induced change of the voice coil inductance indicates that the excursion of the movable diaphragm assembly (thereby also of the voice coil) has been abruptly stopped in the same manner, e.g. by collision with the magnetic circuit structure as mentioned above. The detection of exactly when the movable diaphragm assembly of the loudspeaker has exceeded its excursion limit can be carried out by initially identifying these substantially flat peak plateaus in the voice coil current waveform 605. Thereafter, the shape of the current waveform 605 can be correlated with the corresponding waveform shape of the loudspeaker drive voltage, for example represented by the waveform of the audio input signal. If the loudspeaker drive voltage does not possess a corresponding flat peak plateau at the location of the flat peak plateau in the voice coil current waveform 605, this condition indicates the above-discussed abrupt arrest of excursion of the movable diaphragm assembly.

The non-zero portion of the rectangular curve 609 indicates a time segment of the voice coil current waveform 605 where the movable diaphragm assembly is estimated to exceed its excursion limit. This estimate has been computed by applying the above-mentioned technique based on the detection of correlated flat peak plateaus of the voice coil current waveform 605 and loudspeaker drive voltage.

The invention claimed is:

1. A method of detecting diaphragm excursion of an electrodynamic loudspeaker, comprising steps of:

receiving a digital audio signal having a first sample rate, using an up-sampler and modulator circuit, up-sampling the digital audio signal to a greater second sample rate and adding a high-frequency probe signal to the up-sampled digital audio signal to generate a pulse-modulated composite drive signal, wherein the probe signal has a frequency that exceeds a Nyquist frequency of the received digital audio signal, applying the pulse-modulated composite drive signal to a voice coil of the electrodynamic speaker through an output amplifier, detecting a composite drive signal current flowing through the voice coil in response to the application of the pulse-modulated composite drive signal, detecting a modulation level of a probe signal current from the composite drive signal current, and identifying an excursion of a diaphragm of the loudspeaker based on the detected modulation level of the probe signal current.

2. The method of claim 1, wherein the detecting the modulation level of the probe signal current-comprises steps of:

band-pass filtering the composite drive signal current to attenuate audio signal components therein, and detecting the modulation level of the probe signal current from the band-pass filtered composite drive signal current.

3. The method of claim 1, wherein the detecting the modulation level of the probe signal current comprises: detecting an envelope of the probe signal current.

4. The method of claim 2, wherein the detecting the modulation level of the probe signal current comprises: rectifying and lowpass filtering the band-pass filtered composite drive signal current.

5. The method of claim 1, comprising a step of:

one of pulse density modulating and pulse width modulating the audio signal in the output amplifier to supply a PDM or PWM modulated composite drive signal to the voice coil of the electro dynamic loudspeaker.

6. The method of claim 1, comprising a step of:

up-sampling the digital audio signal by one or more intermediate up-sampling stages producing digital audio signals at respective intermediate sample rates in-between the first and the second sample rates.

7. The method of claim 6, comprising steps of:

generating the high-frequency probe signal as a digital high-frequency probe signal, and adding the digital high-frequency probe signal to one of the digital audio signals at the intermediate sample rates or to a final digital audio signal to generate the composite drive signal in digital format.

8. The method of claim 7, wherein the high-frequency digital probe signal is added to the up-sampled digital audio signal at an intermediate sample rate that is at least two times higher than a frequency of the digital high-frequency probe signal.

9. The method of claim 1, comprising a step of: comparing the detected modulation level of the probe signal current with a specified modulation level threshold.

10. The method of claim 9, comprising a step of:

attenuating a level of the digital audio signal if the detected modulation level of the probe signal current matches the modulation level threshold.

11. The method of claim 1, wherein the high-frequency probe signal comprises a sine wave with a frequency above 10 kHz.

12. The method of claim 1, comprising a step of: adding the high-frequency probe signal to the audio signal by modulating the audio signal with a predetermined carrier frequency such that the high-frequency probe signal is produced by carrier frequency components.

13. The method of claim 1, comprising steps of:

detecting a level of the audio signal, comparing the level of the audio signal with a predetermined threshold level, and adding the high-frequency probe signal to the audio signal exclusively when the level of the audio signal exceeds the predetermined threshold level.

14. The method of claim 1, comprising steps of:

determining an excursion limit of the electrodynamic loudspeaker during a calibration measurement on the electrodynamic loudspeaker or an electrodynamic loudspeaker of the same type, determining and recording the modulation level of the probe signal current corresponding to the excursion limit of the loudspeaker, and deriving the pre-set modulation level criteria from the recorded modulation level of the probe signal current at the excursion limit.

15. The method of d claim 1, comprising a step of:

sampling the probe signal current by an A/D converter to provide a sampled or digital probe signal current.

16. A loudspeaker excursion detector for electrodynamic loudspeakers, comprising:

an audio signal input for receipt of a digital audio signal supplied by an audio signal source, a probe signal source for generation of a high-frequency digital probe signal, an up-sampler and modulator circuit configured to up-sample the audio signal and then combine the up-sampled audio signal with the probe signal to provide a composite drive signal, an output amplifier configured to supply the composite drive signal at a pair of output terminals connectable to a voice coil of an electrodynamic loudspeaker, a current detector configured for detecting from the voice coil a composite drive signal current flowing through the voice coil in response to the application of the composite drive signal, and a modulation detector configured to determine a modulation level of a probe signal current of the composite drive signal current, wherein the modulation level indicates an excursion characteristic of a diaphragm of the electrodynamic loudspeaker.

17. The loudspeaker excursion detector of claim 16, comprising:

a band-pass filter coupled for receipt of the composite drive signal current and providing the probe signal current at a filter output.

18. The loudspeaker excursion detector of claim 17, wherein the modulation detector comprises an envelope detector coupled to the output of the band-pass filter to detect the modulation level.

19. The loudspeaker excursion detector of claim 16, wherein the output amplifier comprises a class D power stage configured to supply a pulse modulated composite drive signal to the voice coil of the electrodynamic loudspeaker.

20. The loudspeaker excursion detector of claim 19, wherein the up-sampler and modulator circuit is configured to up-sample the audio signal through one or more intermediate up-sampling stages configured to produce one or more digital audio signal(s) at respective intermediate sample rate(s) in-between an initial audio signal sample rate and a final sample rate.

21. The loudspeaker excursion detector according to of claim 20, wherein the probe signal source is configured to generate the high-frequency probe signal at a probe signal sample rate; and wherein the up-sampler and modulator circuit comprises a digital signal combiner configured to add the high-frequency probe signal to the digital audio signal at an intermediate sample rate at least two times higher than a frequency of the high-frequency probe signal.

22. The loudspeaker excursion detector of claim 20, wherein the output amplifier comprises one of a pulse density modulated and pulse width modulated power stage coupled for receipt of the digital audio signal at the final sample rate.

23. The loudspeaker excursion detector of claim 16, comprising:

a comparator configured for comparing the detected modulation level of the probe signal current with a pre-set modulation level criteria.

24. The loudspeaker excursion detector of claim 23, comprising:

a diaphragm excursion limiter configured to attenuate a level of the audio signal if the detected modulation level of the probe signal current matches the pre-set modulation level criteria.

25. The loudspeaker excursion detector of claim 16, wherein the current detector comprises an analog-to-digital (A/D) converter to provide a sampled or digital signal representative of the composite drive signal current.

26. The loudspeaker excursion detector of claim 16, wherein the output amplifier comprises a predetermined output impedance less than 1.0Ω at the probe signal frequency.

27. A semiconductor substrate having the loudspeaker excursion detector of claim 16 integrated thereon.

28. An excursion control system for electrodynamic loudspeakers, comprising:

an electrodynamic loudspeaker comprising a movable diaphragm assembly for generating audible sound in response to actuation of the assembly, the loudspeaker excursion detector of claim 16 electrically coupled to the movable diaphragm assembly, an audio signal source operatively coupled to the audio signal input of the loudspeaker excursion detector.

29. The excursion control system for electrodynamic loudspeakers of claim 28, wherein the audio signal source comprises a DSP delivering a digital audio signal to the loudspeaker excursion detector.

* * * * *